United States Patent [19]

Ihrke

[11] Patent Number: 5,038,436

[45] Date of Patent: Aug. 13, 1991

[54] DUAL POSITION HINGE

[75] Inventor: Randy K. Ihrke, Auburn Hills, Mich.

[73] Assignee: General Motors Corporation, Detroit, Mich.

[21] Appl. No.: 576,882

[22] Filed: Sep. 4, 1990

[51] Int. Cl.[5] ..... E05D 7/04

[52] U.S. Cl. ..... 16/249; 16/387

[58] Field of Search ..... 16/235, 237, 238, 245, 16/247, 246, 308, 387, DIG. 29, 270, 249

[56] References Cited

U.S. PATENT DOCUMENTS

| | | | |
|---|---|---|---|
| 426,341 | 4/1890 | Strong | 16/237 |
| 1,124,048 | 1/1915 | Malaspina | 16/249 |
| 2,111,840 | 8/1934 | Chrisman . | |
| 2,277,549 | 3/1941 | Jervis . | |
| 2,615,194 | 10/1952 | Kreiner | 16/237 |
| 2,684,714 | 7/1954 | Corey | 16/237 |
| 4,091,522 | 5/1978 | Suermann et al. | 16/237 |

FOREIGN PATENT DOCUMENTS

| | | | |
|---|---|---|---|
| 469630 | 11/1950 | Canada | 16/238 |
| 252410 | 12/1987 | Fed. Rep. of Germany | 16/245 |
| 8800506 | 9/1989 | Netherlands | 16/238 |

*Primary Examiner*—Richard K. Seidel
*Assistant Examiner*—Edward A. Brown
*Attorney, Agent, or Firm*—Raymond I. Bruttomesso, Jr.

[57] ABSTRACT

A hinge rotatably connecting a paintable closure panel to a closure panel jamb of a vehicle body panel of a motor vehicle and enabling temporary extending motion of the hinge from a retracted position to an extended position, spacing the paintable closure panel away from the vehicle body panel during assembly to allow the painting of the paintable closure panel and the clousre panel jamb. A reinforcement plate mounts to the vehicle body panel and has a pair of slots and a retaining pin hole. A body hinge plate has a pair of rivets that are slideably received by the slots of the reinforcement plate to permit slideable movement of the body hinge plate relative to the reinforcement plate. A gate side strap of the hinge is mounted to the paintable closure panel. A hinge pin hingedly connects the gate side strap to the body hinge plate enabling rotation of the paintable closure panel. A retaining pin temporarily installed in a retaining pin hole in the body hinge plate and the aligned retaining pin hole in the reinforcement plate retains the hinge in the extended position spacing the paintable closure panel from the vehicle body panel to allow for painting of the paintable closure panel and the closure panel jamb. A pair of securing bolts mounts the body hinge plate to the vehicle body panel for retaining the hinge in the retracted position after painting and removal of the retaining pin.

1 Claim, 2 Drawing Sheets

DUAL POSITION HINGE

This invention relates to a closure panel hinge and more particularly to a hinge having a strap with two plates that slide relative to each other to enable temporary extending motion of a paintable closure panel away from a vehicle body panel during assembly to allow the painting of the closure panel.

BACKGROUND OF THE INVENTION

It is known to have vehicle closure panel that is rotatably hinged to a closure panel jamb of a vehicle body panel to enable access through an opening into an interior of the vehicle. As the closure panel opens, a portion of the vehicle closure panel closest to the hinge axis moves inboard toward the closure panel jamb as the majority of the closure panel swings outboard.

It is also known to paint a vehicle by first applying paint to both the body and the closure panel with the closure panel closed. Then the closure panel is opened, so that paint can be applied to the edges of the closure panel and the closure panel jamb on the vehicle. The portion of the vehicle closure panel that swings inboard masks an area of the closure panel jamb and prevents this area from receiving paint both when the closure panel is closed and when it is opened. One solution is to remove the closure panel during the painting process, so that the area of the closure panel jamb that could not be painted when the closure panel was attached may be painted.

It would be desirable to temporarily move the closure panel away from the vehicle panel without removing the panel from the door to allow the painting of the closure panel and closure panel jamb during assembly.

SUMMARY OF THE INVENTION

This invention provides a hinge for rotatably connecting a paintable closure panel to a closure panel jamb of a vehicle body panel of a motor vehicle and also to enable temporary extending motion of the hinge from a retracted position to an extended position, spacing the paintable closure panel away from the vehicle body panel during assembly to allow the painting of the paintable closure panel and the closure panel jamb. The hinge has a body side strap having a reinforcement plate and a body hinge plate. The reinforcement plate mounts to the vehicle body panel and has a pair of slots and a retaining pin hole. The body hinge plate has a pair of rivets that are slideably received by the slots of the reinforcement plate to permit slideable movement of the body hinge plate relative to the reinforcement plate. A gate side strap of the hinge is mounted to the paintable closure panel. A hinge pin hingedly connects the gate side strap to the body side strap enabling rotation of the paintable closure panel in relation to the vehicle body panel. A retaining pin temporarily installed in a retaining pin hole in the body hinge plate and the aligned retaining pin hole in the reinforcement plate retains the hinge in the extended position spacing the paintable closure panel from the vehicle body panel to allow for painting of the paintable closure panel and the closure panel jamb. A pair of securing bolts mounts the body hinge plate to the vehicle body panel for retaining the hinge in the retracted position after painting and removal of the retaining pin.

One object, feature and advantage resides in the provision of a hinge having a body side strap and gate side strap and the hinge enabling rotation of a paintable closure panel between an opened and a closed position and one of the straps having extending motion to allow the hinge to move between a retracted position and an extended position whereby the hinge is placed in the extended position to allow the painting of the paintable closure panel and a closure panel jamb.

Another object, feature and advantage resides in the provision of a reinforcement plate having a pair of slots and a body hinge plate having a pair of rivets that are slideably received by the slots in the reinforcement plate to permit relative slideable movement between the reinforcement plate and the body side plate for moving the hinge to the extended position to allow painting of the closure panel and the closure panel jamb.

Another object, feature and advantage of the invention resides in the provision of a retaining pin received by the retaining pin holes in the reinforcement plate and the body hinge plate for retaining the hinge in the extended position spacing the paintable closure panel from the vehicle body panel to allow for painting of the paintable closure panel.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
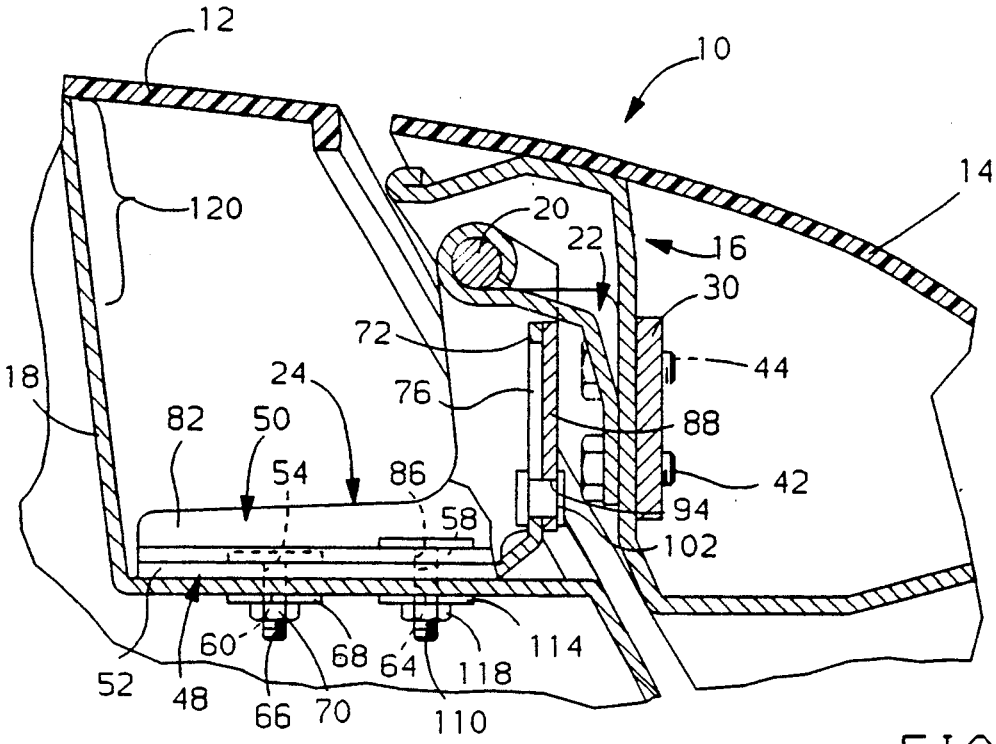
FIG. 1 is a fragmentary side elevation view showing the paintable closure panel in the closed position and the body side strap of the hinge assembly in the retracted position for normal operation.

A motor vehicle 10 has a vehicle body panel 12 to which a paintable closure panel, such as a liftgate 14, is pivotally attached by a hinge assembly 16 to a jamb or header 18 of the vehicle body panel 12 for normal operational movement. The hinge assembly 16 has a hinge pin 20 which rotatably connects a gate side strap 22 mounted on the liftgate 14 to a body side strap 24 mounted on the jamb 18 of the vehicle body panel 12 as seen in FIG. 2. The liftgate 14 rotates about the hinge pin 20 between an opened position of FIG. 4 granting access to an interior of the motor vehicle 10 and a closed position of FIG. 1 blocking access to the interior of the motor vehicle 10.

Figure 2:
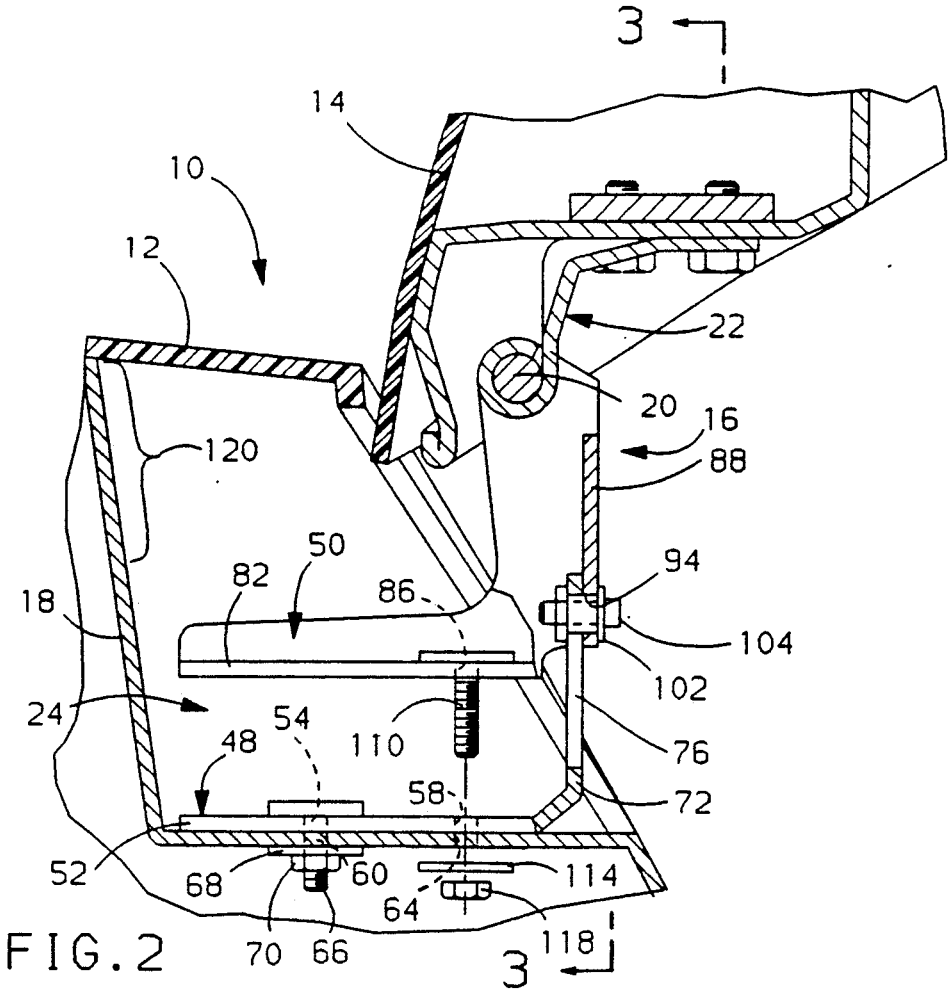
FIG. 2 is a fragmentary side elevation view showing the paintable closure panel in the opened position and the hinge assembly in the extended position spacing apart the paintable closure panel and the vehicle body panel for painting.
Figure 3:
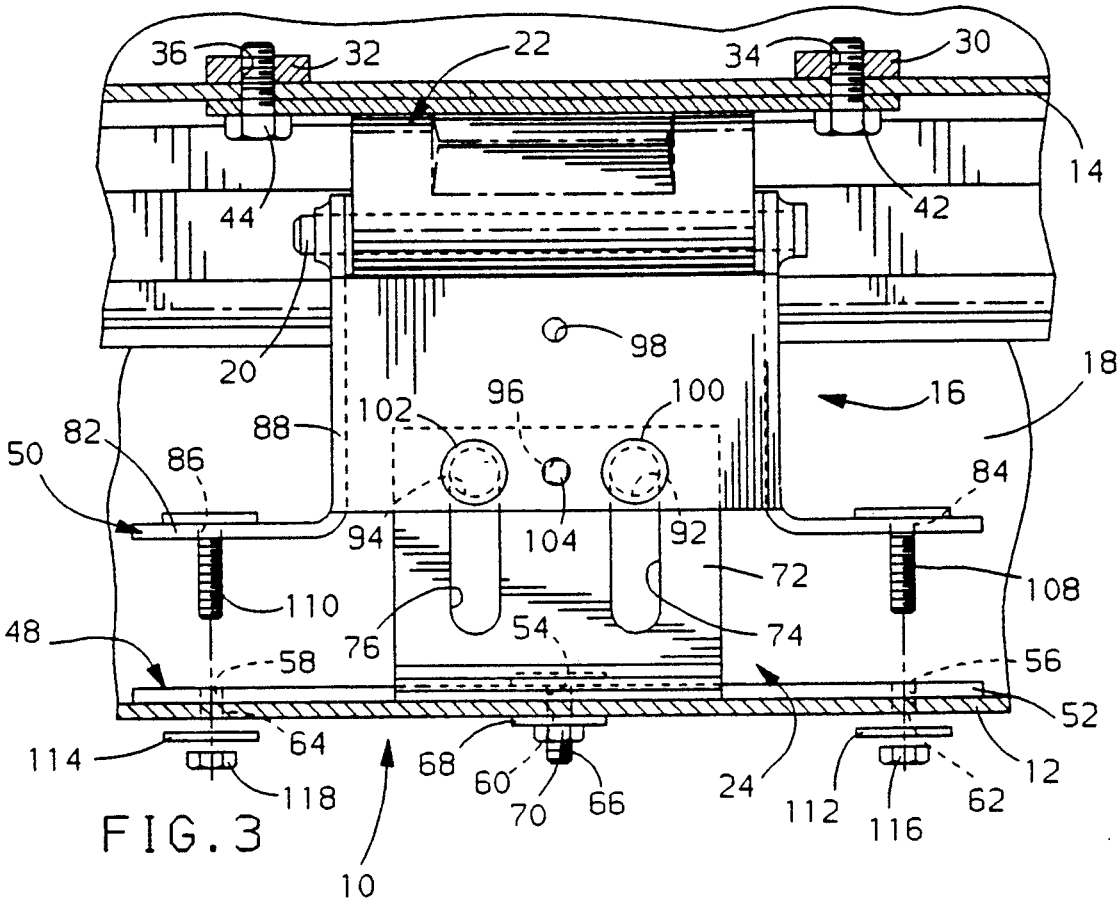
FIG. 3 is a sectional view taken in the direction of arrows 3—3 of FIG. 2.

Referring to FIGS. 2 and 3, a pair of plates 30 and 32 are spot welded or otherwise suitably mounted to the liftgate 14. The plate 30 has a thread hole 34 and the plate 32 has a thread hole 36. A pair of bolts 42 and 44 are received by the thread holes 34 and 36 securing the liftgate side strap 22 to the liftgate 14.

The body side strap 24 has a reinforcement plate 48 and a body hinge plate 50 as seen in FIGS. 2 and 3. The reinforcement plate 48 has an "L" shape with a first leg 52 having three holes 54, 56 and 58 which align with the three holes 60, 62 and 64 located in the jamb 18 of the vehicle body panel 12 as seen in FIGS. 2 and 3. A reinforcement bolt 66 extends through the center hole 54 in the first leg 52 and the hole 60 in the vehicle body panel 12 and is received by a washer 68 and a nut 70 to secure the reinforcement plate 48 to the vehicle body panel 12. A second leg 72 is perpendicular to the first leg 52 and has two slots 74 and 76 as best seen in FIG. 3.

Referring to FIG. 2, the body hinge plate 50 has an "L" shape similar to the reinforcement plate 48. A first arm 82, that is generally parallel to the first leg 52 of the reinforcement plate 48, has a pair of holes 84 and 86 to align with the outer two holes 56 and 58 in the first leg 52. A second arm 88 of the body hinge plate 50, juxtaposed to the second leg 72 of the reinforcement plate 48, has a pair of rivet holes 92 and 94 aligned with the slots 74 and 76 in the reinforcement plate 48 as seen in FIG. 3.

A pair of rivets 100 and 102, as seen in FIG. 3, are received by the rivet holes 92 and 94 of the body hinge plate 50 and are slideably received by the slots 74 and 76 in the reinforcement plate 48 allowing the plates 48 and 50 to slide relative to each other to permit movement of the hinge assembly 16 between a retracted position of FIG. 1 and an extended position of FIGS. 2 and 3.

Figure 4:
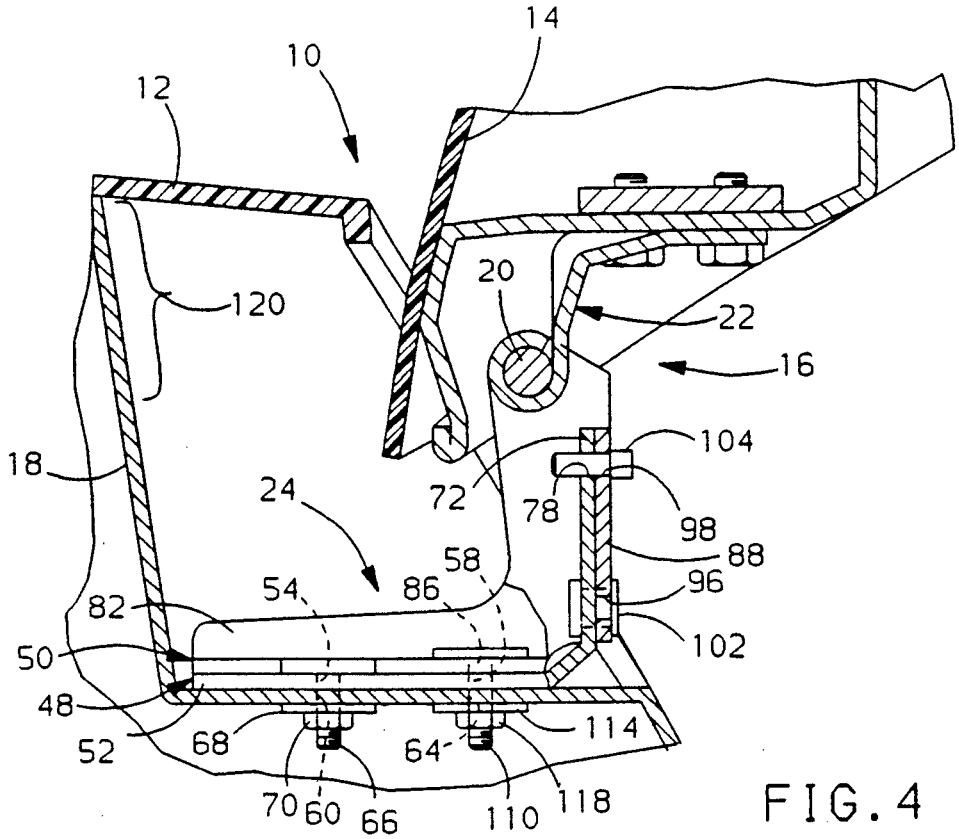
FIG. 4 is a fragmentary side elevation view showing the paintable closure panel in the opened position and the body side strap of the hinge assembly in the retracted position for allowing normal access to the interior of the vehicle.

A retaining pin hole 78 is located in the second leg 72 of the reinforcement plate 48 as seen in FIG. 4. Referring to FIG. 3 and 4, the body hinge plate 50 has a lower retaining pin hole 96 and an upper retaining pin hole 98. A retaining pin 104 may be installed to extend through the retaining pin hole 78 in the reinforcement plate 48 and the lower retaining pin hole 96 in the body hinge plate 50 as seen in FIG. 3 holding the hinge assembly 16 in the extended position or in the upper retaining pin hole 98 as seen in FIG. 4 securing the hinge assembly 16 in the retracted position.

Referring to FIGS. 3 and 4, a pair of securing bolts 108 and 110 extend through the holes 84 and 86 in the first arm 82 of the body hinge plate 50 and the outer holes 56 and 58 in the first leg 52 of the reinforcement plate 48 and the outer holes 62 and 64 in the vehicle body panel 12 and are received by a pair of washers 112 and 114 and a pair of nuts 116 and 118. The securing bolts 108 and 110 may be added to the motor vehicle 10 after the painting process is completed as described below or the securing bolts 108 and 110 can be of such a length that they and the washers 112 and 114 and the nuts 116 and 118 can be initially installed while the liftgate 14 is in the painting position of FIGS. 2 and 3 and the nuts 116 and 118 tightened later.

To install and paint the liftgate 14, the hinge assembly 16 is first secured to the liftgate 14. The liftgate 14 and the hinge assembly 16 is then secured to the liftgate jamb 18 of the vehicle body panel 12 by the reinforcement bolt 66.

The body hinge plate 50 is then slid relative to the reinforcement plate 48, moving the hinge assembly 16 upward from the retracted position of FIG. 1 to the extended position and the liftgate 14 is rotated upward to the opened position shown in FIG. 2 for painting. A pair of support rods, not shown, are temporarily attached between the liftgate 14 and the vehicle body panel 12 by the operator to support the liftgate in the opened position for painting. Referring to FIG. 3, the retaining pin 104 is inserted into the lower retaining pin hole 96 in the body hinge plate 50 and the aligned retaining pin hole 78 in the reinforcement plate 48 to keep the hinge assembly 16 in the extended position.

A paint spray gun operated roboticly applies paint from above the liftgate 14 and then below the liftgate 14. The paint spray gun is able to spray paint into an area generally designated by number 120 on the jamb 18 by spraying from below the liftgate 14, which would not be reachable if the liftgate 14 was in either the closed position of FIG. 1 or the opened position of FIG. 4, when the hinge assembly 16 is in the retracted position.

When the painting is completed, the retaining pin 104 is removed and the rivets 100 and 102 slide relative to the slots 74 and 76 in the reinforcement plate 48, moving the hinge assembly 16 downward from the extended position to the retracted position of FIG. 4. The retaining pin 104 is secured by a force fit or other means in the retainer pin hole 78 of the reinforcement plate 48 and the now aligned upper retaining pin hole 98 of the body hinge plate 50.

The securing bolts 108 and 110 extend through the holes 84 and 86 in the first arm of the body hinge plate 50 strap and the outer holes 56 and 58 in the first leg 52 of the reinforcement plate 84 and the outer holes 62 and 64 in the in the vehicle body panel 12 and are received by the washers 112 and 114 and the nuts 116 and 118 to secure the hinge assembly 16 in the retracted position.

The support rods are removed from between the liftgate 14 and the vehicle body panel 12 and replaced with a pair of conventional supports, such as pneumatic lifts, which assist in movement of and support of the liftgate 14 relative to the vehicle body panel 12 in normal operational movement.

While an embodiment of the present invention has been explained, various modifications within the spirit and scope of the following claims will be readily apparent to those skilled in the art.

The embodiments of the invention in which an exclusive property or privilege is claimed are defined as follows:

1. A hinge for rotatably connecting a paintable closure panel to a closure panel jamb of a vehicle body panel of a motor vehicle and also to enable temporary extending motion of the hinge from a retracted position to an extended position spacing the paintable closure panel away from the vehicle body panel during assembly to allow the painting of the paintable closure panel and the closure panel jamb, the hinge comprising:

a body side strap having a reinforcement plate and a body hinge plate;

the reinforcement plate mounted to the vehicle body panel, the reinforcement plate having a horizontal and a vertical leg, said vertical leg defining a pair of slots and a retaining pin hole;

the body hinge plate having a horizontal and a vertical arm, said vertical arm receiving a pair of rivets that are slideably received by the slots of the reinforcement plate to permit slideable movement of the body hinge plate relative to the reinforcement plate, the body hinge plate vertical arm having a retaining pin hole aligned with the retaining pin hole in the reinforcement plate when the hinge is in the extended position;

a gate side strap mounted to the paintable closure panel;

a hinge pin hingedly connecting the gate side strap to the body side strap to enable rotation of the paintable closure panel in relation to the vehicle body panel;

a retaining, pin received by the retaining pin holes in the vertical leg of the reinforcement plate and the vertical arm of the body hinge plate for retaining the hinge in the extended position spacing the paintable closure panel from the vehicle body panel to allow for painting of the paintable closure panel and the closure panel jamb; and a pair of securing bolts mounting the horizontal leg of the reinforcement plate and the horizontal arm of the body hinge plate to the vehicle body panel for retaining the hinge in the retracted position after painting.

* * * * *